US010204606B1

(12) United States Patent
Chang

(10) Patent No.: US 10,204,606 B1
(45) **Date of Patent: *Feb. 12, 2019**

(54) APPARATUS FOR ENHANCING SOUNDS PRODUCED OUT OF SINGLE-REED WIND MUSIC INSTRUMENTS

(71) Applicant: Shun-Hwa Chang, Fremont, CA (US)

(72) Inventor: Shun-Hwa Chang, Fremont, CA (US)

( * ) Notice: Subject to any disclaimer, the term of this patent is extended or adjusted under 35 U.S.C. 154(b) by 20 days.

This patent is subject to a terminal disclaimer.

(21) Appl. No.: 15/404,105

(22) Filed: Jan. 11, 2017

Related U.S. Application Data

(63) Continuation-in-part of application No. 14/831,872, filed on Aug. 21, 2015, now Pat. No. 9,570,052.

(51) Int. Cl.
*G10D 9/02* (2006.01)

(52) U.S. Cl.
CPC ..... *G10D 9/023* (2013.01)

(58) Field of Classification Search
CPC ..... G10D 9/02; G10D 9/023
See application file for complete search history.

(56) References Cited

U.S. PATENT DOCUMENTS 1,506,364 A 8/1924 Parme et al.
1,667,836 A 5/1928 Brockman, Jr.
1,779,522 A 10/1930 Widmayer
2,296,737 A 9/1942 Peterson
2,342,836 A 2/1944 Brilhart
2,669,897 A 2/1954 Topor
3,267,791 A 8/1966 Roberts
3,905,268 A 9/1975 Gamble
4,014,241 A 3/1977 Gamble
4,172,482 A * 10/1979 Gomez ..... G10D 9/023 144/363
4,979,420 A 12/1990 Cusack et al.
(Continued)

FOREIGN PATENT DOCUMENTS

EP 2450875 A1 5/2012
EP 2498247 A1 9/2012
(Continued)

OTHER PUBLICATIONS

EPO, Search Report (62261 EPO—counterpart for the parent case) dated Jan. 13, 2017.

(Continued)

*Primary Examiner* — Kimberly Lockett
(74) *Attorney, Agent, or Firm* — Roger H. Chu

(57) ABSTRACT

Apparatus for enhancing tunes produced out of single-reed wind music instrument are disclosed. Apparatus comprise one or more sound enhancing elements in form of a plurality of elongated ribs or grooves, or one or more studs. The sound enhancing elements are affixed to either side or both sides of a reed. Patterns of the elongated ribs/grooves can be straight or wavy lines orientated in longitudinal, transverse or oblique direction with respect to the reed. Each stud contains a 3-D geometric shape portion for altering sounds produced out of a single-reed wind music instrument when played by a player, and a base of the 3-D geometric shape portion for affixing the stud to either side or both sides of a reed in an effective area. Dimensions/locations of the effective area are single-reed wind music instrument dependent.

18 Claims, 17 Drawing Sheets

(56) References Cited

U.S. PATENT DOCUMENTS

| | | | | |
|---|---|---|---|---|
| 5,227,572 | A | 7/1993 | Cusack et al. | |
| 5,542,331 | A | 8/1996 | Hartmann et al. | |
| 6,087,571 | A | 7/2000 | Legere | |
| 6,673,992 | B1 | 1/2004 | Runyon | |
| 7,902,443 | B2 | 3/2011 | Legere et al. | |
| 8,766,072 | B2 | 7/2014 | Ku | |
| 9,570,052 | B1 * | 2/2017 | Chang | G10D 9/023 |
| 2009/0217799 | A1 | 9/2009 | Rovner | |

FOREIGN PATENT DOCUMENTS

| | | |
|---|---|---|
| GB | 20385 | 6/1903 |
| GB | 439516 | 12/1935 |

OTHER PUBLICATIONS

USPTO, Office Action for U.S. Appl. No. 14/831,872 (parent case) dated Sep. 15, 2016.
USPTO, Notice of Allowance for U.S. Appl. No. 14/831,872 (parent case) dated Oct. 26, 2016.

* cited by examiner

| (mm) | $D_1$ | $D_2$ | $W_{min}$ | $W_{max}$ | $H_{min}$ | $H_{max}$ |
|---|---|---|---|---|---|---|
| Eb Clarinet | 5 | 20 | 0.5 | 5 | 1 | 4 |
| Bb Clarinet, A Clarinet | 13 | 32 | 0.5 | 10 | 1 | 4 |
| Bass Clarinet | 16 | 44 | 0.5 | 14 | 1 | 6 |
| Alto Clarinet | 14 | 35 | 0.5 | 12 | 1 | 5 |
| Soprano Saxophone | 11 | 27 | 0.5 | 11 | 1 | 5 |
| Alto Saxophone | 14 | 35 | 0.5 | 13 | 1 | 5 |
| Tenor Saxophone | 16 | 44 | 0.5 | 14 | 1 | 6 |
| Baritone Saxophone | 17 | 45 | 0.5 | 16 | 1 | 8 |

*FIG. 13*

APPARATUS FOR ENHANCING SOUNDS PRODUCED OUT OF SINGLE-REED WIND MUSIC INSTRUMENTS

CROSS-REFERENCE TO RELATED APPLICATIONS

This application is continuation-in-part (CIP) of a pending U.S. patent application for "APPARATUS FOR ENHANCING SOUNDS PRODUCED OUT OF SINGLE-REED WIND MUSIC INSTRUMENTS", Ser. No. 14/831,872, filed on Aug. 21, 2015.

FIELD

The invention generally relates to musical instrument accessories, and more particularly to apparatus for enhancing sounds produced out of single-reed wind music instruments (e.g., saxophone, clarinet) when played by a player.

BACKGROUND

A reed wind music instrument contains some type of resonator (usually a tube), in which a column of air is set into vibration by a player blowing into (or over) a mouthpiece set at the end of the resonator. The pitch of the vibration is determined by the length of the tube and by manual modifications of the effective length of the vibrating column of air. In reed-blown wind music instruments, sounds are produced by blowing air into a mouthpiece which then causes a reed to vibrate. A reed is a thin strip of material made from natural cane or synthetic materials having strength properties equivalent to natural cane. Single-reed instruments include various types of saxophones (soprano, alto, tenor, baritone) and clarinets (Bb or B Flat, Eb or E Flat, A, bass, alto). Sound quality produced by traditional reeds made of either natural cane or synthetic material can sometimes be unsatisfactory.

Therefore, it would be desirable to have an apparatus that can enhance tunes produced out of a single-reed wind music instrument when played.

BRIEF SUMMARY

This section is for the purpose of summarizing some aspects of the invention and to briefly introduce some preferred embodiments. Simplifications or omissions in this section as well as in the abstract and the title herein may be made to avoid obscuring the purpose of the section. Such simplifications or omissions are not intended to limit the scope of the invention.

The inventor observed that sounds/tunes produced by a reed configured with one or more sound enhancing elements in accordance with several embodiments of the invention are significantly different from those produced by reeds without.

Apparatus for enhancing tunes produced out of single-reed wind music instrument are disclosed. According to one example embodiment, a reed having one or more sound enhancing elements configured either on the top side or on the bottom side of the reed, such that the reed would vibrate differently when played by a player. Bottom side is also referred to as table side. At least one sound enhancing element are in form of a plurality of elongated ribs or grooves, or one or more studs. Elongated grooves and ribs can be arranged or orientated in various patterns: straight lines, wavy lines, geometric shapes, etc.

Reeds with sound enhancing elongated grooves or ribs may be made of synthetic materials and integrally manufactured in plastic forming mold. Alternatively, reeds with sound enhancing elongated grooves or ribs may be made of natural cane and integrally manufactured with computer controlled machine. Sound enhancing ribs can also be made separated from the reed as an add-on accessory as studs.

According to another example embodiment, sound enhancing elements include one or more studs affixed to either side or both sides of a reed. Each stud contains a three-dimensional (3-D) geometric shape portion for altering airflow blown through by a player, and a base of the 3-D geometric shape portion for affixing the stud to the top side of a reed in an area located in the heart of the reed. Dimensions of the area are single-reed wind music instrument dependent.

According to yet another example embodiment, sound enhancing elements include one or more studs affixed to either side or both sides of a reed. Each stud contains a three-dimensional (3-D) geometric shape portion for altering airflow blown through by a player, and a base of the 3-D geometric shape portion for affixing the stud to the table side of a reed in an area directly opposite to the heart of the reed. Dimensions of the area are single-reed wind music instrument dependent.

Studs may be integrally manufactured with a synthetic reed in plastic forming mold. Studs may also be separately manufactured as accessories to be affixed to a reed via attachment means (e.g., adhesives, glues, push pins, etc.). One or more studs may be affixed to a reed singly or in any combination of same type or mixed type. More than one studs as a group may be prearranged onto a sheet having attachment means configured in the opposite side (e.g., peel-off adhesive sheet).

According to yet another example embodiment, a reed having at least one sound enhancing element configured on each of the top and the bottom sides of a reed, such that the reed would vibrate differently when played by a player. At least one sound enhancing element comprises a plurality of ribs, or one or more studs on the top side, and a plurality of grooves, a plurality of ribs, or one or more studs on the bottom side.

Objects, features, and advantages of the invention will become apparent upon examming the following detailed description of an embodiment thereof, taken in conjunction with the attached drawings.

BRIEF DESCRIPTION OF THE DRAWINGS

These and other features, aspects, and advantages of the invention will be better understood with regard to the following description, appended claims, and accompanying drawings as follows:

FIG. 13 is a table summarizes various dimensions of sound enhancing element and various dimensions of the effective area on either side of the reed for various single-reed wind music instruments according to one embodiment of the invention.

DETAILED DESCRIPTION

In the following description, numerous specific details are set forth in order to provide a thorough understanding of the invention. However, it will become obvious to those skilled in the art that the invention may be practiced without these specific details. The descriptions and representations herein are the common means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Used herein, the terms "top" and "bottom", "front" and "rear", "longitudinal" and "transverse", "vertical" and "horizontal", and "oblique" are intended to provide relative positions for the purposes of description, and are not intended to designate an absolute frame of reference.

Embodiments of the invention are discussed herein with reference to FIGS. 1A-14D. However, those skilled in the art will readily understand and appreciate that the detailed descriptions given herein with respect to these figures is for explanatory purposes as the invention extends beyond these limited embodiments.

Figure 1A:
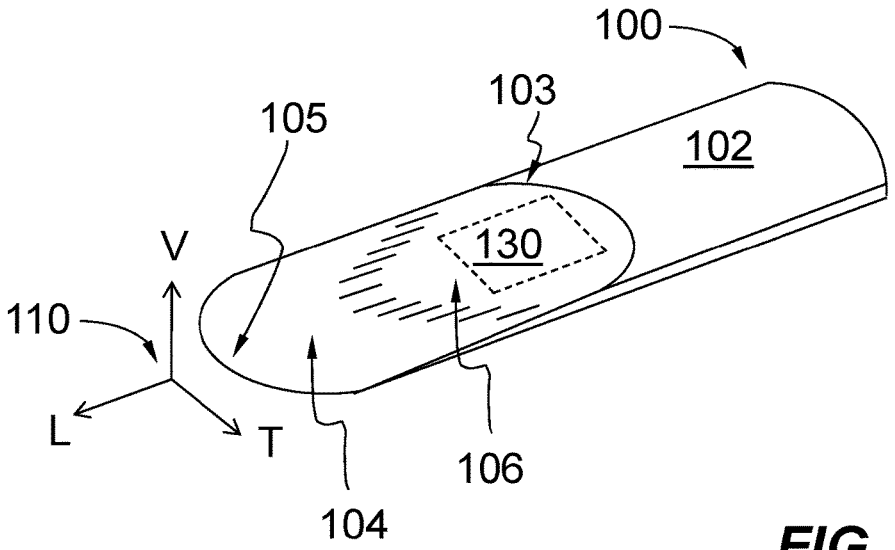
FIG. 1A is a perspective view depicting the top side of an example reed according to one embodiment of the invention.

Referring first to FIG. 1A, it is shown a top front perspective view of an example reed 100 for single-reed wind music instruments (e.g., saxophone, clarinet) in accordance with one embodiment of the invention. The reed 100, made from either natural cane or synthetic material, has a rounded-top rear or stock portion 102 extended by a front or vamp portion 104 that tapers to a tip 105, which matches the shape of the mouthpiece of a particular wind music instrument. The border between vamp portion 104 and stock portion 102 is referred to as the shoulder 103 of the reed 100. A raised area having slightly thicker material (i.e., a hump on top) located at the vamp portion 105 near the shoulder 103 is referred to as the heart 106 of a reed 100.

A Cartesian coordinate system 110 is shown to indicate three unique directions representing three spatial dimensions of the reed 100: V for the vertical direction (bottom-to-top as shown), L for the longitudinal direction (rear-to-front as shown) and T for the transverse direction (right-to-left as shown). Reed 100 is placed in a mouthpiece such that the table side 108 is for air being blown through from the tip 105 towards the rear or stock portion 102 by a player of the wind music instrument to produce various sounds/tunes. According to one embodiment of the invention, one or more sound enhancing elements are attached to an area 130 (i.e., first effective area) located in the heart 106 of the reed 100. Dimensions of the area 130 are single-reed wind music instrument dependent. One or more sound enhancing elements are in form of a plurality of elongated ribs, or one or more studs affixed to a reed's top side.

Figure 1B:
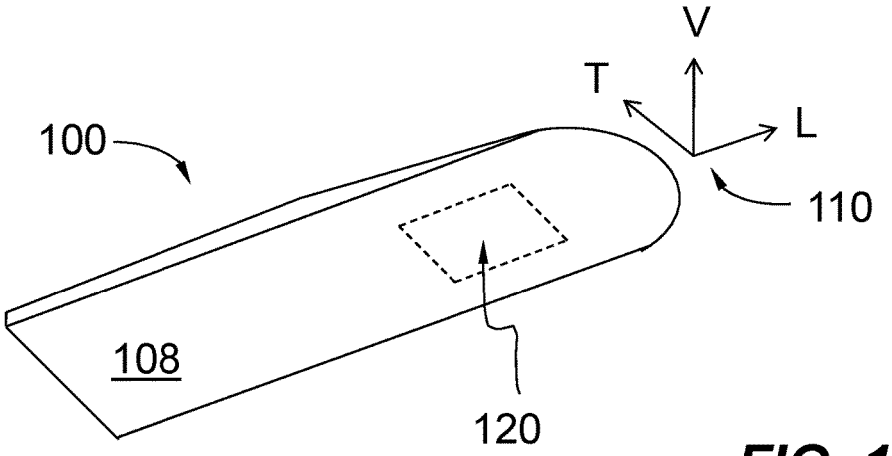
FIG. 1B is a perspective view depicting the table side of the example reed of FIG. 1A in accordance with one embodiment of the invention.

FIG. 1B is a bottom front perspective view of the example reed 100. An area 120 (i.e., second effective area) directly opposite to the heart 106 on the flat surface of the table or bottom side 108 is the location for attaching one or more sound enhancing elements according to another embodiment of the invention. Dimensions of the area 120 are also single-reed wind music instrument dependent. One or more sound enhancing elements are in form of a plurality of elongated ribs or grooves, or one or more studs affixed to a reed's table side.

Figure 1C:
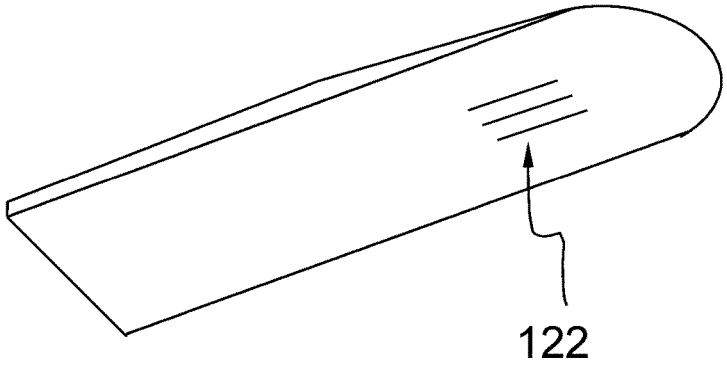
FIG. 1C is a perspective view depicting the bottom/table side of a reed having example elongated ribs/grooves configured thereon in accordance with one embodiment of the invention.
Figure 1D:
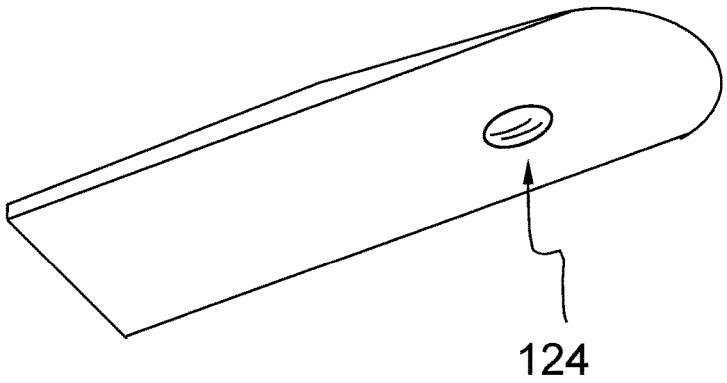
FIG. 1D is a perspective view depicting the bottom/table side of a reed having an example stud configured thereon in accordance with one embodiment of the invention.

FIG. 1C shows a perspective view of the table side having a plurality of example elongated ribs/grooves 122 configured thereon. FIG. 1D shows a perspective view of the table side having an example stud 124 configured thereon.

Figure 1E:
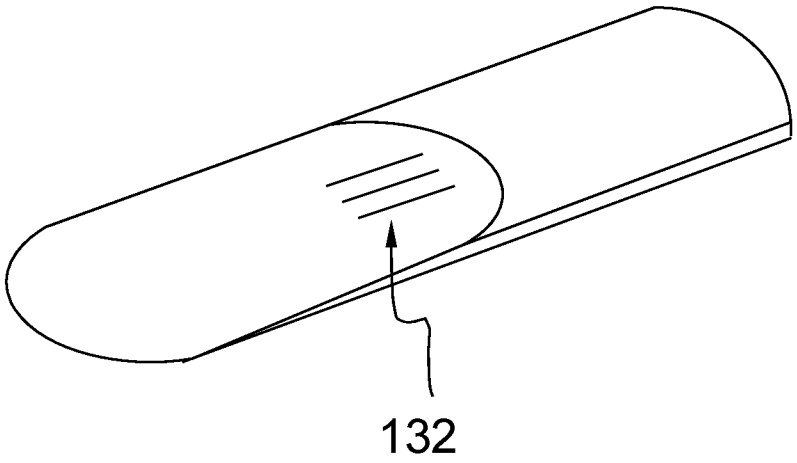
FIG. 1E is a perspective view depicting the top side of a reed having example elongated ribs configured thereon in accordance with one embodiment of the invention.
Figure 1F:
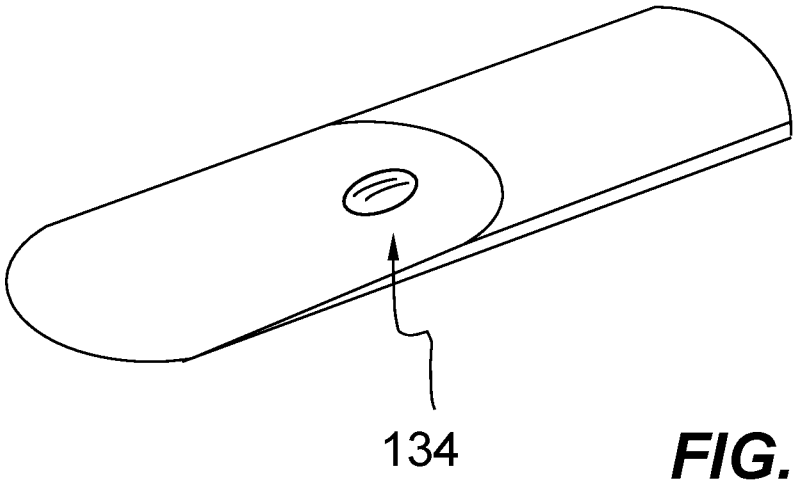
FIG. 1F is a perspective view depicting the top side of a reed having example stud configured thereon in accordance with one embodiment of the invention.

For sound enhancing elements configured on the top side of a reed, FIG. 1E shows a top front perspective view for a reed having a plurality of example ribs 132. FIG. 1F shows an example stud 134 configured on the top side of a reed.

Figure 2A:
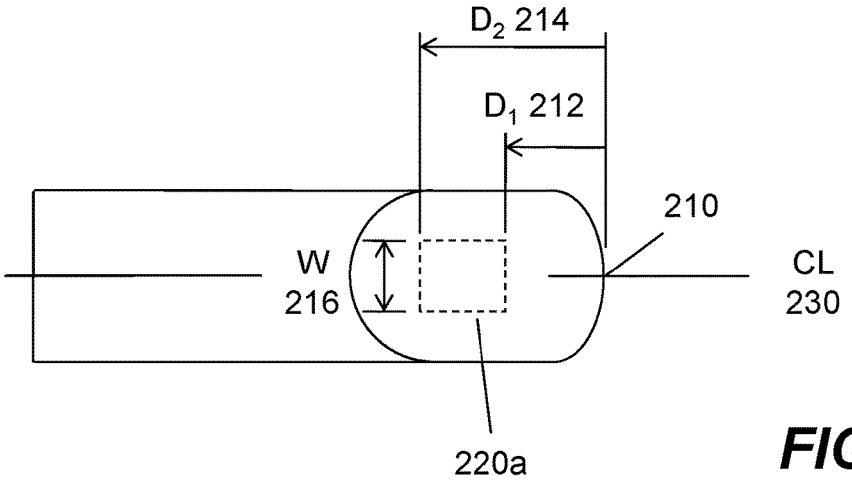
FIG. 2A is a plan view of an example reed's top side in accordance with one embodiment of the invention.
Figure 2B:
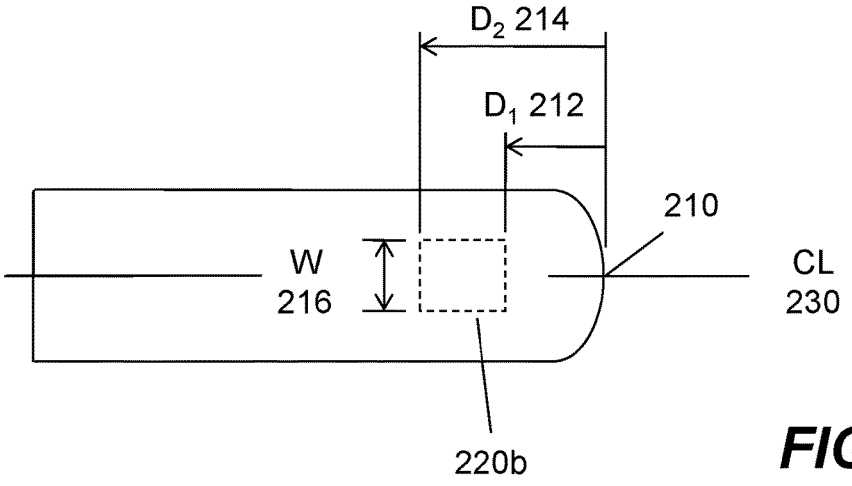
FIG. 2B is a plan view of an example reed's bottom side in accordance with one embodiment of the invention.

FIG. 2A and FIG. 2B are plan views of an example reed's top side and bottom side, respectively. One or more sound enhancing elements are configured in a top effective area 220*a* (i.e., first area 130 of FIG. 1A) and/or a bottom effective area 220*b* (i.e., the second area 120 of FIG. 1B). Both top and bottom effective areas 220*a*-220*b* are defined by width W 216, near distance $D_1$ 212 measured from the reed's tip 210 and far distance $D_2$ 214 measured from the reed's tip 210.

Both top and bottom effective areas 220*a*-220*b* are located on the centerline CL 230 of the reed. Dimensions of the top effective area 220*a* and the bottom effective area 220*b* are single-reed wind music instrument dependent as shown in FIG. 13. Single-reed wind music instrument includes, Bb or B Flat clarinet, Eb or E Flat clarinet, A clarinet, bass clarinet, alto clarinet, soprano saxophone, alto saxophone, tenor saxophone, and baritone saxophone.

Figure 3A:
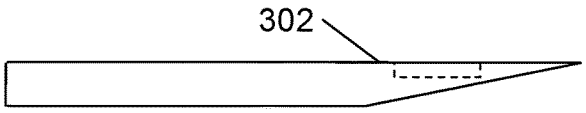
FIGS. 3A-3E show elevation views of an example reed in accordance with one embodiment of the invention.
Figure 3B:
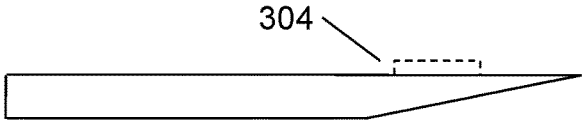
Figure 3C:
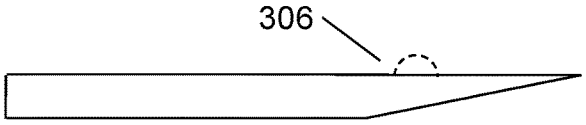

For sound enhancing elements configured on the bottom side of a reed, FIG. 3A is an elevation view showing a reed with example grooves 302 while FIG. 3B is an elevation view showing a reed having example ribs 304. FIG. 3C is an elevation view showing a reed having an example stud 306 configured thereon.

Figure 3D:
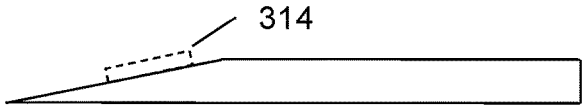
Figure 3E:
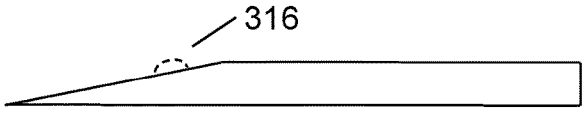
Figure 4A:
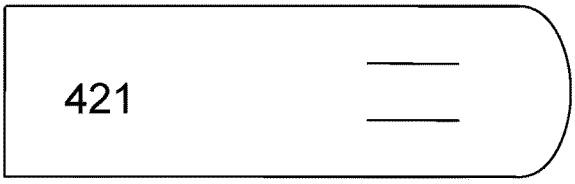
FIGS. 4A-4E are plan views of the table/bottom side of an example reed showing various patterns of sound enhancing elements (i.e., elongated ribs or grooves) in accordance with one embodiment of the invention.
Figure 4B:
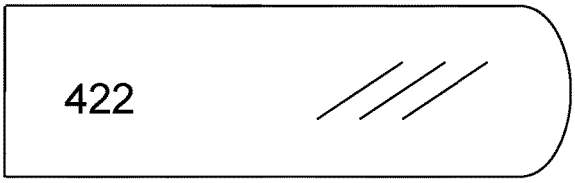
Figure 4C:
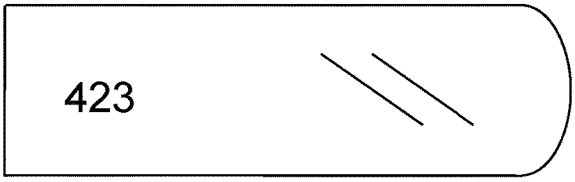
Figure 4D:
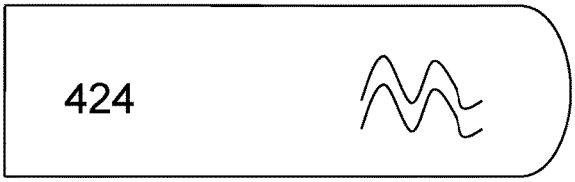
Figure 4E:
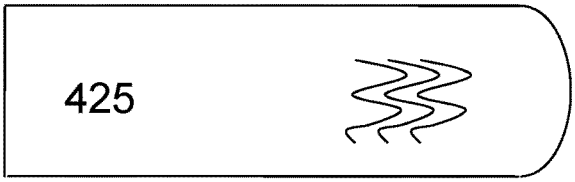
Figure 4F:
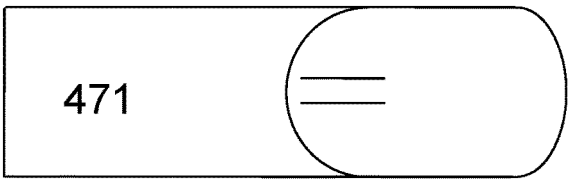
FIGS. 4F-4J are plan views of the top side of an example reed showing various patterns of sound enhancing elements (i.e., elongated ribs) in accordance with one embodiment of the invention.
Figure 4G:
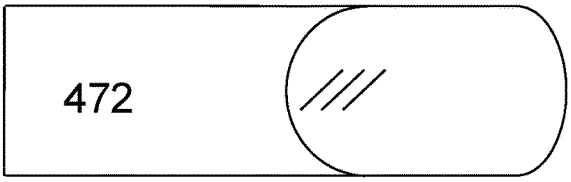
Figure 4H:
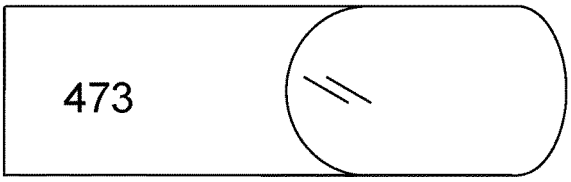
Figure 4I:
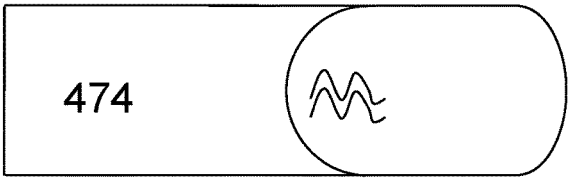
Figure 4J:
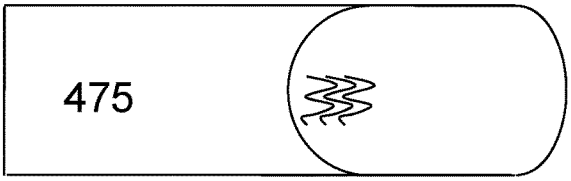

For sound enhancing elements configured on the top side of a reed, FIG. 3D shows example ribs 314 and FIG. 3E shows example stud 316.

FIGS. 4A-4E are plan views showing the bottom side of example reeds having various patterns of elongated ribs/grooves 421-425 configured thereon. The first view shows a plurality of substantially parallel straight-line ribs/grooves 421 in the longitudinal direction of the reed. The second and third views show a plurality of substantially parallel straight-line ribs/grooves 422-423 in respective oblique directions (i.e., a direction oblique to the longitudinal direction) of the reed. The fourth view shows a plurality of substantially parallel wavy-line ribs/grooves 424 along the longitudinal direction of the reed, while the fifth view shows a plurality of substantially parallel wavy-line ribs/grooves 425 along the transverse direction of the reed.

Similarly, FIGS. 4F-4J are plan views showing the top side of example reeds having various patterns of elongated ribs 471-475 configured thereon.

Although patterns of elongated ribs/grooves 421-425 shown in FIGS. 4A-4E and elongated ribs 471-475 shown in FIGS. 4F-4J are substantially parallel, the invention does not limit to parallel patterns or orientations. Furthermore, the elongated ribs/grooves 421-425 and the elongated ribs 471-475 can have unequal spacing between them.

In another embodiment, the pattern of elongated ribs/grooves is configured to substantially mimic grain patterns of natural cane wood.

Figure 5A:
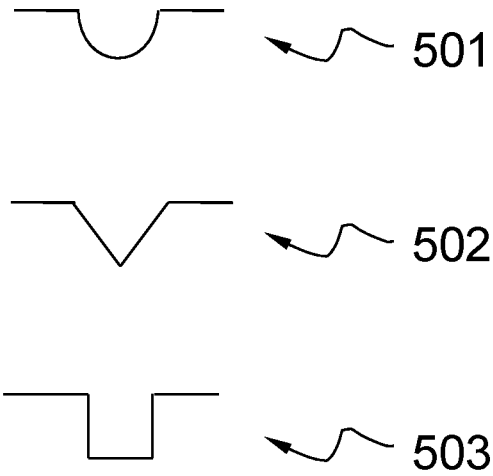
FIG. 5A shows various example geometric profiles of grooves in accordance with an embodiment of the invention.
Figure 5B:
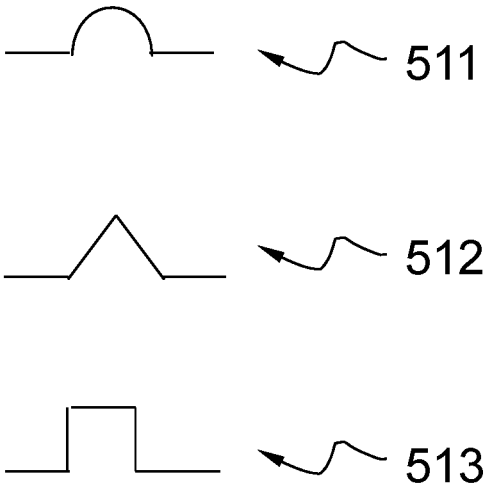
FIG. 5B shows various example geometric profiles of ribs in accordance with an embodiment of the invention.

FIG. 5A shows various example profile views 501-503 of a groove. The first profile view 501 shows a recessed semi-circular or semi-oval profile; the second profile view 502 shows a recessed triangular profile; and the third profile view 503 shows a recessed rectangular or squared profile. Profile views 511-513 of a rib are shown in FIG. 5B, which are raised profile opposite to those in profile views 501-503, respectively.

Figure 6:
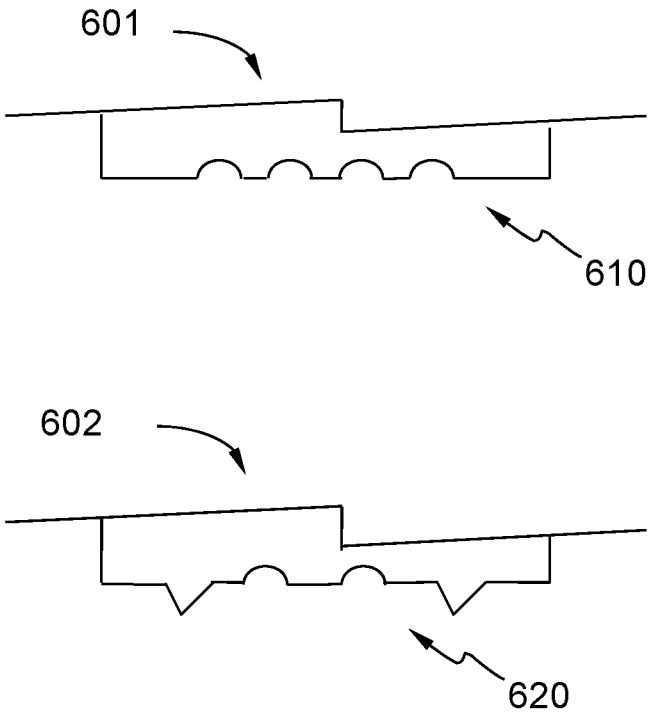
FIG. 6 shows several elevation views of ribs/grooves in accordance with various embodiments of the invention.

FIG. 6 shows two elevation views of ribs/grooves. The first view 601 shows a semi-circular recessed profile of ribs/grooves 610. The second view 602 shows a mixed raised/recessed profile with different types of ribs and grooves 620. Those ordinary skilled in the art would know that profiles of other types of ribs/grooves could also be shown in a similar manner of FIG. 6.

Figure 7:
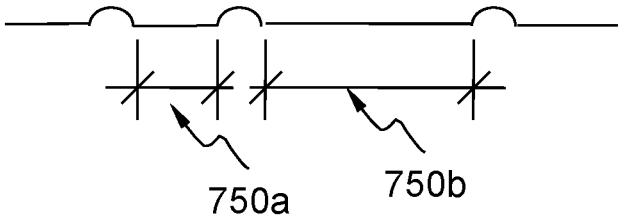
FIG. 7 is a diagram depicting example spacing of ribs/grooves in accordance with one embodiment of the invention.

FIG. 7 shows example spacing 750*a*-*b* of ribs/grooves. According to one embodiment, The spacing 750*a*-*b* are between 0.5 mm and 5 mm.

In one embodiment, reeds with sound enhancing elongated grooves or ribs may be made of synthetic materials and integrally manufactured in plastic forming mold. In another embodiment, reeds with sound enhancing elongated grooves or ribs may be made of natural cane and integrally manufactured with computer controlled machine.

According to one embodiment, one or more sound enhancing elements are in form of one or more studs affixed to a reed's table/bottom side. Each stud contains a three-dimensional (3-D) geometric shape portion for altering airflow blown through by a player, and a base for affixing the stud to the table side of a reed.

Figure 8:
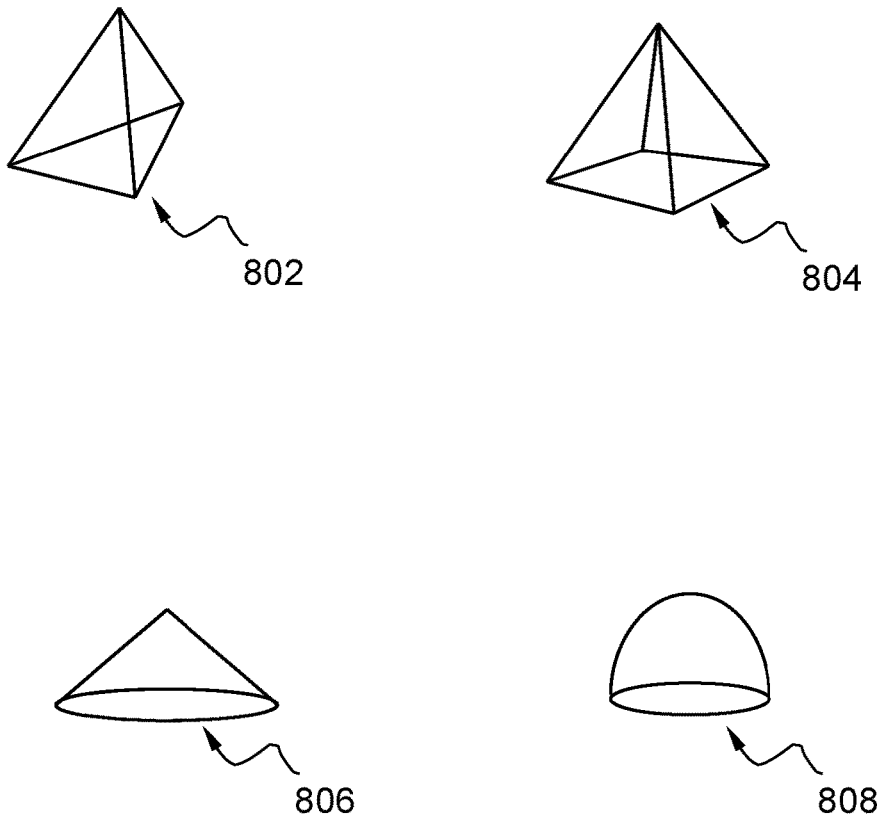
FIG. 8 is a diagram showing various example 3-D geometric shapes of a sound enhancing element (i.e., stud) in accordance with one embodiment of the invention.

FIG. 8 shows various example 3-D geometric shapes including, but not limited to, pyramid (triangle base pyramid 802, quadrilateral base pyramid 804), cone 806 and dome 808. Other 3-D geometric shapes (not shown) may include a portion of sphere or ellipsoid, a combination of two partial ellipsoid (e.g., a portion of tear drop shape or oval shape). Edges and corners of the 3-D geometric shape can be rounded. The invention sets no limit. Any 3-D geometric shape may be used in the 3-D geometric shape portion of a stud.

Figure 9:
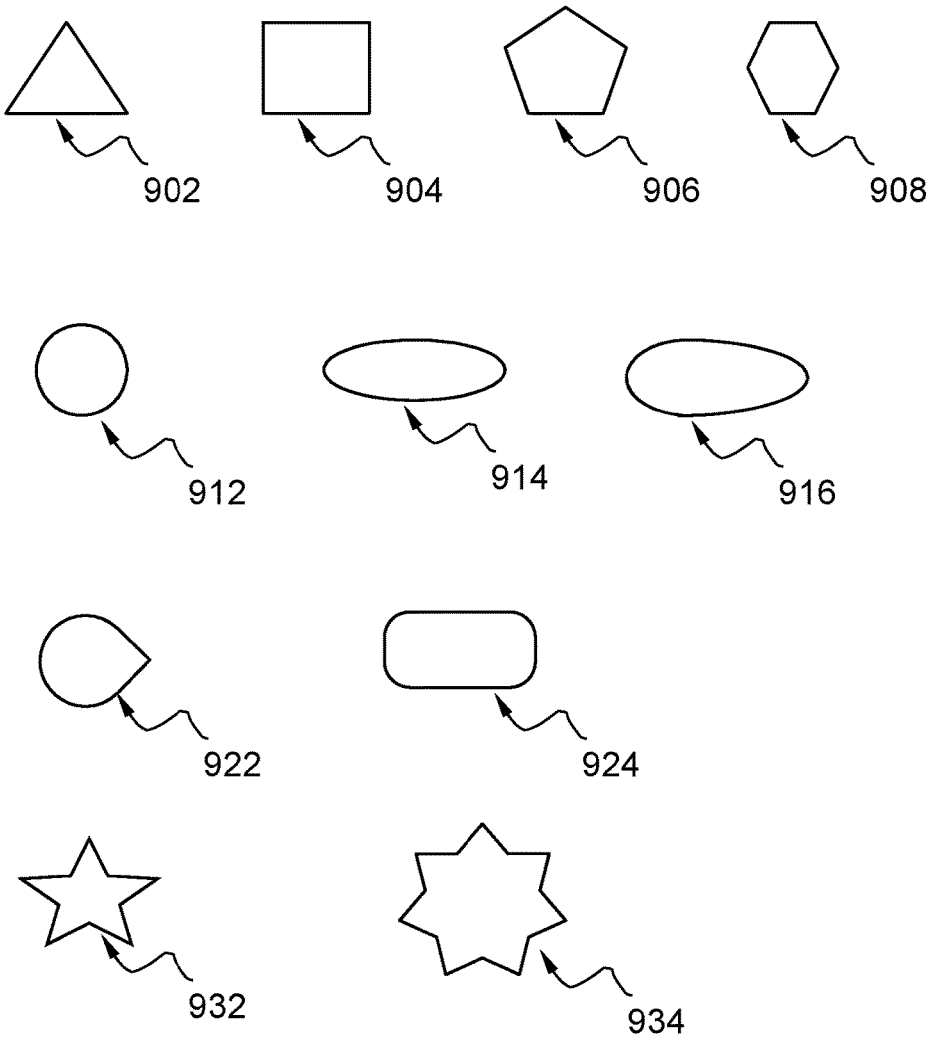
FIG. 9 is a diagram showing various example base shapes of sound enhancing element (i.e., stud) in accordance with one embodiment of the invention.

As shown in FIG. 9, there are many different example shapes that can be used in the base, according to one embodiment of the invention. Any polygon (e.g., triangle 902, quadrilateral 904, pentagon 906, hexagon 908, etc.) can be used in the base. The base shape may be circle 912, ellipse 914, tear drop shape 916, circle with one sharp point 922, rounded corner rectangle 924, 5-point star 932, 7-point star 934, etc. Again, the invention sets no limit as to the base shape.

Figure 10:
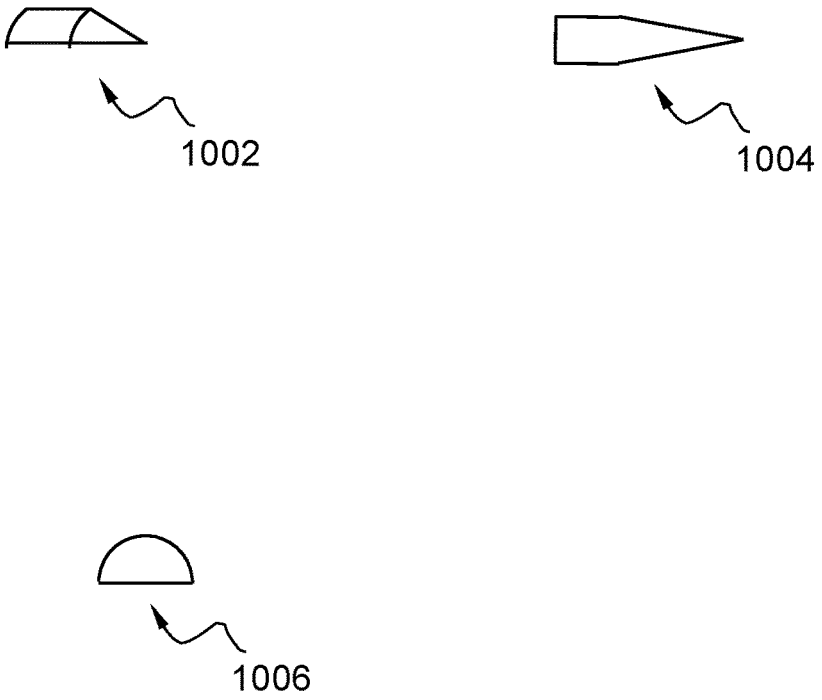
FIG. 10 is a diagram showing an example sound enhancing element (i.e., stud) having a sharp pointed nose portion in accordance with one embodiment of the invention.

In another embodiment, a stud may include a sharp pointed nose portion designed for pointing towards the opposite direction of airflow. An example stud having a pointed nose portion 1002 is shown in FIG. 10. The base shape 1004 and the front/rear view 1006 are also shown.

In yet another embodiment, there can be more than one stud arranged in different patterns.

FIGS. 11A-11E are various plan views showing the bottom side of example reeds having different patterns of studs 1111-1115 configured thereon.

Figure 11A:
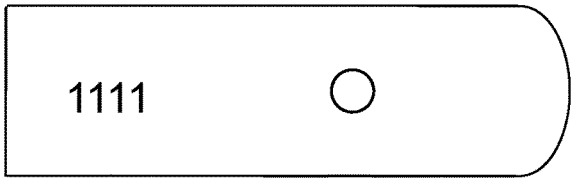
FIGS. 11A-11E are plan views of a reed's bottom side having different arrangements of one or more sound enhancing elements in accordance with one embodiment of the invention.
Figure 11B:
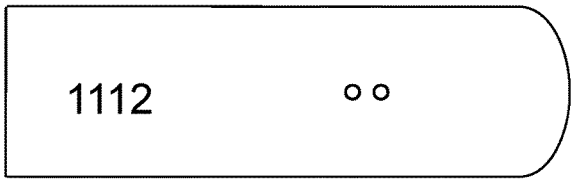

An example stud is shown as a round or circular shape stud 1111 configured on bottom/table side of a reed in FIG. 11A. Circular shape stud 1111 may be a partial dome or other equivalent 3-D geometric shape that can alter airflow. FIG. 11B shows two studs arranged in a column in the direction of airflow blown through by a player.

Figure 11C:
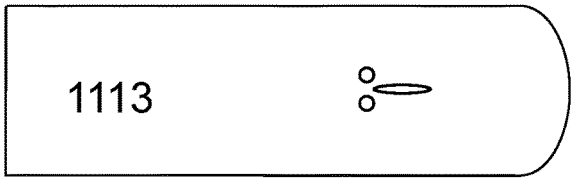

In another embodiment, mixed types of studs 1113 (i.e., two circular-base and one elliptical-base) are configured on the bottom/table side of a reed shown in FIG. 11C. Those of ordinary skill in the art would know that other numbers or patterns of same or different studs can achieve the same.

Figure 11D:
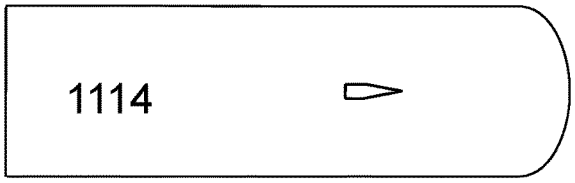
Figure 11E:
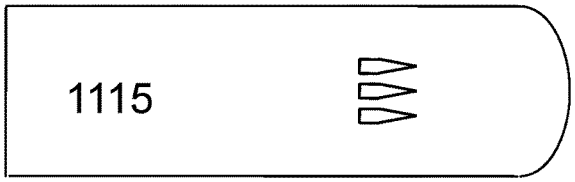
Figure 11F:
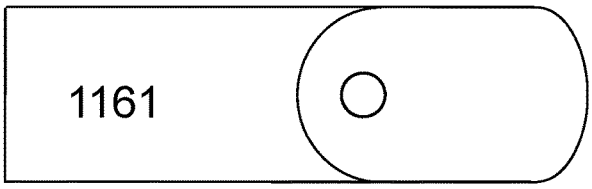
FIGS. 11F-11J are plan views of a reed's top side having different arrangements of one or more sound enhancing elements in accordance with one embodiment of the invention.
Figure 11G:
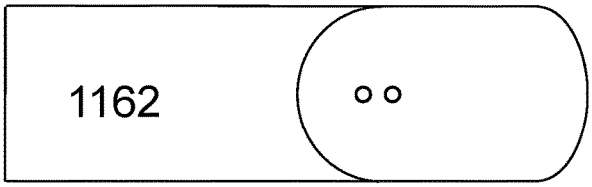
Figure 11H:
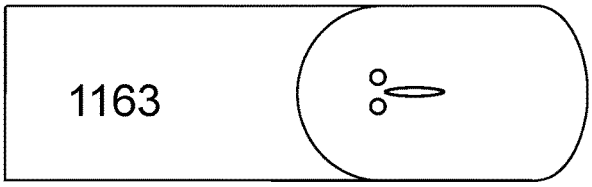
Figure 11I:
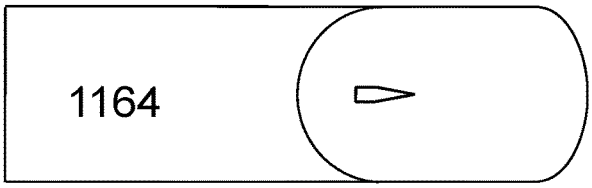
Figure 11J:
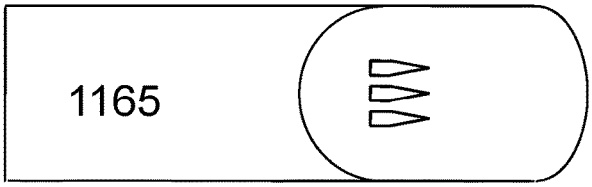

FIG. 11D shows a stud having a sharp nose portion 1114 that points towards the tip of a reed. Similar to the studs shown in FIGS. 11A-11C, other numbers or patterns can be used for achieving the same. For example, FIG. 11E shows three of them 1115 configured.

Substantially similar patterns of studs 1161-1165 may also be configured on the top side of example reeds shown in FIGS. 11F-11J.

Furthermore, studs may be integrally manufactured with a synthetic reed in plastic forming mold. Studs may be made of natural cane and integrally manufactured with computer controlled machine. Studs may also be separately manufactured as accessories to be affixed to a reed via attachment means (e.g., adhesives, glues, push pins, etc.). One or more studs may be affixed to a reed singly or in any combination of same type or mixed type. More than one studs as a group may be prearranged onto a sheet having attachment means configured in the opposite side (e.g., peel-off adhesive sheet).

Figure 12A:
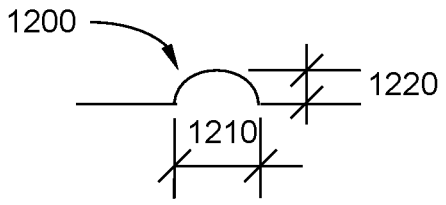
FIGS. 12A-12B are diagrams showing dimension definitions of example sound enhancing elements according to an embodiment of the invention.
Figure 12B:
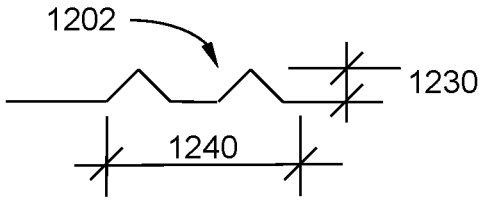

FIG. 12A. shows a semi-circular profile 1200 of an example stud, which can be any of the studs shown in previous figures. Each stud is bounded by width 1210 and height 1220. Those having ordinary skill in the art would know that these dimension limits can be applied to other shapes of studs. FIG. 12B shows a double triangular profile 1202 of a group of example studs. The group of studs is bounded by width 1240 and height 1230. In order to provide sound enhancement, the width and height are limited to the minimum and maximum values defined in FIG. 13.

FIG. 13 is a table summarizes various dimensions of sound enhancing element and various dimensions of the effective area (i.e., top effective area 220*a* of FIG. 2A or bottom effective area 220*b* of FIG. 2B) on either side of a reed for various single-reed wind music instruments according to one embodiment of the invention. All dimensions listed therein are in millimeters (mm). $H_{min}$ and $H_{max}$ represent minimum and maximum heights of a sound enhancing element (i.e., stud, rib or groove). $W_{min}$ and $W_{max}$ represent minimum and maximum widths of sound enhancing element either singly or the entire group when there are more than one sound enhancing elements. $D_1$ 212 and $D_2$ 214 are defined (shown in FIGS. 2A-2B) as near distance and far distance from the reed's tip 210, respectively.

Figure 14A:
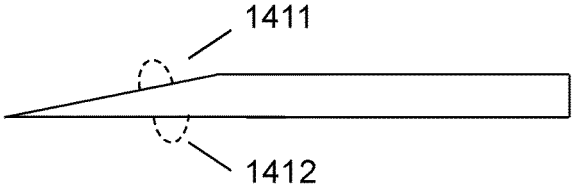
FIGS. 14A-14D are diagrams showing profiles of a reed with different example combinations of sound enhancing elements configured on both sides of the reed in accordance with one embodiment of the invention.
Figure 14B:
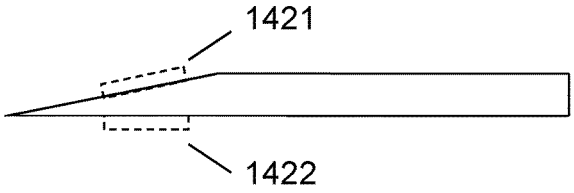
Figure 14C:
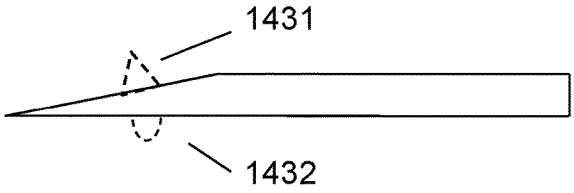
Figure 14D:
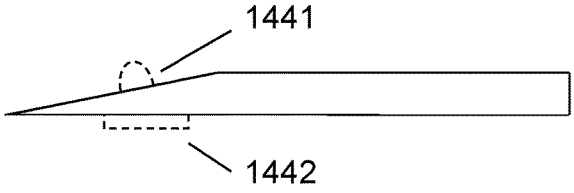

Sound enhancing elements can be configured on both sides of a reed. FIGS. 14A-14D show profiles of a reed with different example combinations of sound enhancing elements configured on both sides in accordance with one embodiment of the invention. FIG. 14A shows two identical studs 1411-1412 as sound enhancing elements on a reed. FIG. 14B shows two identical ribs 1421-1422 as sound enhancing elements on a reed. Sound enhancing elements may not be identical. For example, two different studs 1431-1432 can be configured on a reed shown in FIG. 14C. FIG. 14D shows a combination using a stud 1441 and ribs 1442. The invention sets no limit as to what kinds of combination of studs and ribs.

Although the invention has been described with reference to specific embodiments thereof, these embodiments are merely illustrative, and not restrictive of, the invention. Various modifications or changes to the specifically disclosed exemplary embodiments will be suggested to persons skilled in the art. For example, whereas several patterns of ribs/grooves have been shown and described, other patterns may be used to accomplish the same, for example, broken-line pattern. Additionally, whereas various shapes (shown in profile views) of rib/groove have been shown and described, other shapes may be used to accomplish the same, for example, a hexagon shape. Further, whereas various 3-D geometric shapes of studs have been shown and described, other 3-D geometric shapes may be used to accomplish the same (i.e., enhancing tunes produced). Furthermore, various patterns and numbers of sound enhancing elements have been shown and described, other patterns and numbers may be used to achieve the same, the invention does not set limit as to number, shape and pattern of sound enhancing elements to be configured on a reed. Further, the top and/or bottom effective areas for attaching sound enhancing elements have been shown and described as a rectangular area. Other two-dimensional shape to enclose the effective area may be used to achieve the same, for example, an oval area. Finally, for illustration simplicity and visual purpose, the dimension of reed and sound enhancing elements are not drawn to scale. Those having ordinary skill in the art would appreciate the figures representing the invention. In summary, the scope of the invention should not be restricted to the specific exemplary embodiments disclosed herein, and all modifications that are readily suggested to those of ordinary skill in the art should be included within the spirit and purview of this application and scope of the appended claims.

I claim:

1. An apparatus for enhancing sounds produced out of a single-reed wind music instrument comprising:

one or more sound enhancing elements being configured on a reed's top side in an area located in the reed's heart for altering the reed's vibrational behaviors while played by a player; wherein dimensions of said area are single-reed wind music instrument dependent, and said dimensions are defined by near distance $D_1$ and far distance $D_2$ measured from the reed's tip, and said area having a width between minimum width $W_{min}$, and maximum width $W_{max}$; and each of said one or more sound enhancing elements having a single-reed wind music instrument dependent height between minimum height $H_{min}$ and maximum height $H_{max}$; wherein said one or more sound enhancing elements comprise one or more studs and each stud includes a three-dimensional (3-D) geometric shape portion and a base of the 3-D geometric shape portion for affixing to the reed's top side.

2. The apparatus of claim 1, wherein, when the single-reed wind music instrument is a Bb or B Flat clarinet, or an A clarinet, said near distance $D_1$, said far distance $D_2$, said minimum width $W_{min}$, said maximum width $W_{max}$, said minimum height $H_{min}$ and said maximum height $H_{max}$ are 13 mm, 32 mm, 0.5 mm, 10 mm, 1 mm and 4 mm, respectively.

3. The apparatus of claim 1, wherein, when the single-reed wind music instrument is a bass clarinet or a tenor saxophone, said near distance $D_1$, said far distance $D_2$, said minimum width $W_{min}$, said maximum width $W_{max}$, said minimum height $H_{min}$ and said maximum height $H_{max}$ are 16 mm, 44 mm, 0.5 mm, 14 mm, 1 mm and 6 mm, respectively.

4. The apparatus of claim 1, wherein, when the single-reed wind music instrument is an alto clarinet or an alto saxophone, said near distance $D_1$, said far distance $D_2$, said minimum width $W_{min}$, said maximum width $W_{max}$, said minimum height $H_{min}$ and said maximum height $H_{max}$ are 14 mm, 35 mm, 0.5 mm, 12 mm, 1 mm and 5 mm, respectively.

5. The apparatus of claim 1, wherein, when the single-reed wind music instrument is a soprano saxophone, said near distance $D_1$, said far distance $D_2$, said minimum width $W_{min}$, said maximum width $W_{max}$, said minimum height $H_{min}$ and said maximum height $H_{max}$ are 11 mm, 27 mm, 0.5 mm, 11 mm, 1 mm and 5 mm, respectively.

6. The apparatus of claim 1, wherein, when the single-reed wind music instrument is a baritone saxophone, said near distance $D_1$, said far distance $D_2$, said minimum width $W_{min}$, said maximum width $W_{max}$, said minimum height $H_{min}$ and said maximum height $H_{max}$ are 17 mm, 45 mm, 0.5 mm, 16 mm, 1 mm and 8 mm, respectively.

7. The apparatus of claim 1, wherein said each stud is affixed to the reed at the base with attachment means.

8. The apparatus of claim 1, wherein said minimum width $W_{min}$ and said maximum width $W_{max}$ are limits for said each stud or for said one or more studs together as a group.

9. The apparatus of claim 1, wherein said one or more sound enhancing elements comprise a plurality of elongated ribs.

10. An apparatus for enhancing sounds produced out of a single-reed wind music instrument comprising:

a first sound enhancing element being configured on a reed's top side within a first area in the reed's heart;

a second sound enhancing element being configured on a reed's bottom side within a second area directly opposite to the reed's heart;

wherein the first and the second sound enhancing elements are for altering the reed's vibrational behaviors while played by a player;

wherein dimensions of said first area and said second area are single-reed wind music instrument dependent, and said dimensions are defined by near distance $D_1$ and far distance $D_2$ measured from the reed's tip, and said first and said second areas having a width between minimum width $W_{min}$ and maximum width $W_{max}$; and each of said first and said second sound enhancing elements having a single-reed wind music instrument dependent height between minimum height $H_{min}$ and maximum height $H_{max}$; wherein said first and said second sound enhancing elements comprise one or more studs and each stud includes a three-dimensional (3-D) geometric shape portion and a base of the 3-D geometric shape portion for affixing to the reed's top side.

11. The apparatus of claim 10, wherein, when the single-reed wind music instrument is a Bb or B Flat clarinet, or an A clarinet, said near distance $D_1$, said far distance $D_2$, said minimum width $W_{min}$, said maximum width $W_{max}$, said minimum height $H_{min}$ and said maximum height $H_{max}$ are 13 mm, 32 mm, 0.5 mm, 10 mm, 1 mm and 4 mm, respectively.

12. The apparatus of claim 10, wherein, when the single-reed wind music instrument is a bass clarinet or a tenor saxophone, said near distance $D_1$, said far distance $D_2$, said minimum width $W_{min}$, said maximum width $W_{max}$, said minimum height $H_{min}$ and said maximum height $H_{max}$ are 16 mm, 44 mm, 0.5 mm, 14 mm, 1 mm and 6 mm, respectively.

13. The apparatus of claim 10, wherein, when the single-reed wind music instrument is an alto clarinet or an alto saxophone, said near distance $D_1$, said far distance $D_2$, said minimum width $W_{min}$, said maximum width $W_{max}$, said minimum height $H_{min}$ and said maximum height $H_{max}$ are 14 mm, 35 mm, 0.5 mm, 12 mm, 1 mm and 5 mm, respectively.

14. The apparatus of claim 10, wherein, when the single-reed wind music instrument is a soprano saxophone, said near distance $D_1$, said far distance $D_2$, said minimum width $W_{min}$, said maximum width $W_{max}$, said minimum height $H_{min}$ and said maximum height $H_{max}$ are 11 mm, 27 mm, 0.5 mm, 11 mm, 1 mm and 5 mm, respectively.

15. The apparatus of claim 10, wherein, when the single-reed wind music instrument is a baritone saxophone, said near distance $D_1$, said far distance $D_2$, said minimum width $W_{min}$, said maximum width $W_{max}$, said minimum height $H_{min}$ and said maximum height $H_{max}$ are 17 mm, 45 mm, 0.5 mm, 16 mm, 1 mm and 8 mm, respectively.

16. The apparatus of claim 10, wherein aid first and said second sound enhancing elements comprise a plurality of elongated ribs.

17. The apparatus of claim 10, wherein said first sound enhancing element comprises at least one stud and said second sound enhancing element comprises a plurality of ribs.

18. The apparatus of claim 10, wherein said second sound enhancing element comprises at least one stud and said first sound enhancing element comprises a plurality of ribs.

* * * * *